US011842829B2

(12) United States Patent
Shahidi et al.

(10) Patent No.: US 11,842,829 B2
(45) Date of Patent: Dec. 12, 2023

(54) FLEXIBLE ELECTRICAL CABLE WITH FOUR COPPER LAYERS

(71) Applicants: International Business Machines Corporation, Armonk, NY (US); Computer Task Group, Inc., Amherst, NY (US)

(72) Inventors: Sassan K. Shahidi, San Jose, CA (US); Hoodin Hamidi, San Francisco, NY (US); David Harper, Vail, AZ (US); Larry LeeRoy Tretter, Tucson, AZ (US)

(73) Assignee: International Business Machines Corporation, Armonk, NY (US)

( * ) Notice: Subject to any disclaimer, the term of this patent is extended or adjusted under 35 U.S.C. 154(b) by 31 days.

(21) Appl. No.: 17/655,563

(22) Filed: Mar. 21, 2022

(65) Prior Publication Data

US 2023/0298782 A1 Sep. 21, 2023

(51) Int. Cl.

| | |
|---|---|
| ***H01B 7/02*** | (2006.01) |
| ***H01B 3/30*** | (2006.01) |
| ***H01B 7/18*** | (2006.01) |
| ***H01B 7/00*** | (2006.01) |
| *H01B 7/29* | (2006.01) |

(52) U.S. Cl.
CPC ..... *H01B 7/0225* (2013.01); *H01B 3/306* (2013.01); *H01B 7/0009* (2013.01); *H01B 7/188* (2013.01); *H01B 7/292* (2013.01)

(58) Field of Classification Search
CPC ..... H01B 3/306; H01B 7/02; H01B 7/028; H01B 7/0216; H01B 7/0291; H01B 7/0225; H01B 7/009; H01B 7/188; H01B 7/292; H01B 7/08; H01B 7/29; H05K 1/0259; H05K 1/118; H05K 1/117; H05K 1/092; H05K 3/321; H05K 3/1216
USPC ..... 174/110 R, 113 R, 117 R, 117 F, 117 FF, 174/250, 251, 254, 255, 256, 258, 259, 174/260
See application file for complete search history.

(56) References Cited

U.S. PATENT DOCUMENTS

| | | | | |
|---|---|---|---|---|
| 4,116,516 A * | 9/1978 | Griffin | H01R 12/62 | 439/493 |
| 4,480,288 A | 10/1984 | Gazdik | | |
| 4,626,298 A | 12/1986 | Allard | | |
| 4,755,911 A * | 7/1988 | Suzuki | H05K 1/0353 | 361/795 |
| 4,798,918 A | 1/1989 | Kabadi | | |
| 4,845,311 A * | 7/1989 | Schreiber | H01P 11/005 | 174/117 FF |
| 5,003,273 A * | 3/1991 | Oppenberg | H05K 1/0219 | 174/117 FF |
| 5,008,656 A | 4/1991 | Cheriff | | |
| 5,373,109 A * | 12/1994 | Argyrakis | H01R 12/774 | 174/117 FF |

(Continued)

FOREIGN PATENT DOCUMENTS

CN 107113966 A * 8/2017 ..... H05K 1/0259

*Primary Examiner* — William H. Mayo, III
(74) *Attorney, Agent, or Firm* — Stosch Sabo

(57) ABSTRACT

An electrical cable including four copper layers, where at least two of the four copper layers are separated by a polymeric base layer, and where at least two of the four copper layers are separated by an adhesive. The electrical cable further includes a polymeric cover layer adhered to an outermost copper layer.

19 Claims, 4 Drawing Sheets

(56) References Cited

U.S. PATENT DOCUMENTS

| | | | | |
|---|---|---|---|---|
| 6,093,894 | A * | 7/2000 | Carlson | H05K 3/361 174/117 FF |
| 6,900,390 | B2 | 5/2005 | Halter | |
| 7,086,869 | B1 * | 8/2006 | Dangler | H05K 1/0218 439/502 |
| 7,094,074 | B2 | 8/2006 | Chiou | |
| 7,116,522 | B2 * | 10/2006 | Poorman | G11B 5/4893 |
| 8,237,051 | B2 * | 8/2012 | Sexton | H01B 7/0216 174/117 FF |
| 2014/0076607 | A1 | 3/2014 | Brock | |

* cited by examiner

FLEXIBLE ELECTRICAL CABLE WITH FOUR COPPER LAYERS

BACKGROUND

The present disclosure relates to electronic wiring, and, more specifically, to a flexible electrical cable with four copper layers.

Electronic cabling can use copper layers to transport electrical signals between electronic components coupled together by the electronic cabling. Traditional cabling utilizes two copper layers that may be separated by electrically insulative material and encased in a sheath.

SUMMARY

Aspects of the present disclosure are directed toward an electrical cable comprising first and second cores, each core including a polymeric base layer sandwiched by top and bottom copper layers. The electrical cable further comprise an adhesive layer between the first and second cores and bonding the first and second cores together. The electrical cable further comprises a first polymeric cover layer bonded to an outer surface of the first core, and a second polymeric cover layer bonded to an outer surface of the second core.

Additional aspects of the present disclosure are directed toward an electrical cable comprising a top polymeric cover layer adhered to a first core, the first core comprising a first copper layer and a first polymeric base layer. The electrical cable further comprises a second core bonded to the first core, where the second core comprises a second polymeric base layer sandwiched between a second copper layer and a third copper layer. The electrical cable further comprises a third core bonded to the second core, the third core comprising a fourth copper layer and a third polymeric base layer. The electrical cable further comprises a bottom polymeric cover layer adhered to the third core.

Additional aspects of the present disclosure are directed toward an electrical cable comprising four copper layers, where at least two of the four copper layers are separated by a polymeric base layer, and where at least two of the four copper layers are separated by an adhesive. The electrical cable further comprises a polymeric cover layer adhered to an outermost copper layer The present summary is not intended to illustrate each aspect of, every implementation of, and/or every embodiment of the present disclosure.

BRIEF DESCRIPTION OF THE DRAWINGS

The drawings included in the present application are incorporated into and form part of the specification. They illustrate embodiments of the present disclosure and, along with the description, serve to explain the principles of the disclosure. The drawings are only illustrative of certain embodiments and do not limit the disclosure.

Figure 1:
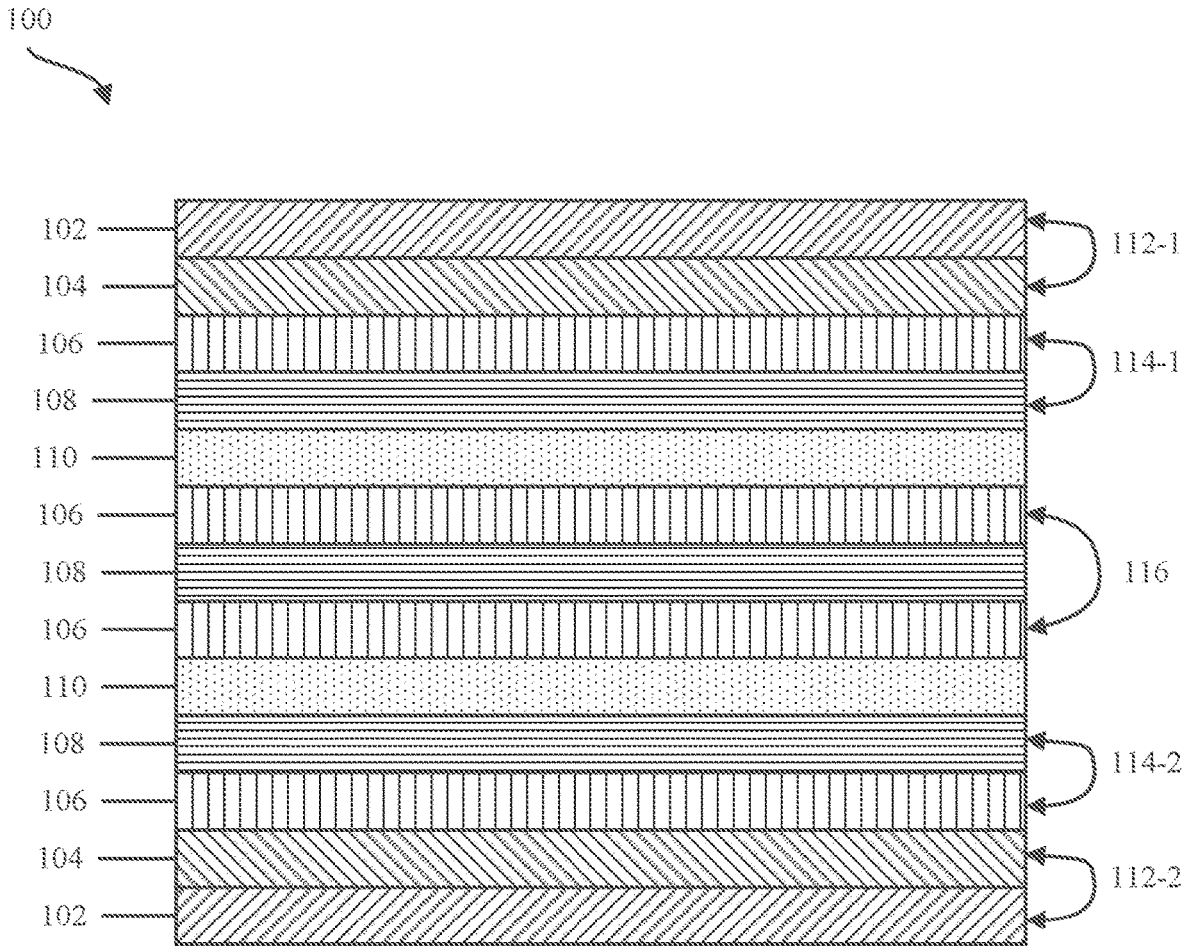
FIG. 1 illustrates a block diagram of a cross-section of a first example electrical cable, in accordance with some embodiments of the present disclosure.

While the present disclosure is amenable to various modifications and alternative forms, specifics thereof have been shown by way of example in the drawings and will be described in detail. It should be understood, however, that the intention is not to limit the present disclosure to the particular embodiments described. On the contrary, the intention is to cover all modifications, equivalents, and alternatives falling within the spirit and scope of the present disclosure.

DETAILED DESCRIPTION

Aspects of the present disclosure are directed toward electronic wiring, and, more specifically, to a flexible electrical cable with four copper layers. While not limited to such applications, embodiments of the present disclosure may be better understood in light of the aforementioned context.

In electronic cabling, the number of active electrical traces can define the bandwidth of the wiring. However, the number of active electrical traces for a flexible cable design is limited by the trace width and spacing within a particular flexible cable. A narrower trace width and/or trace spacing is impractical due to fabrication limitations. One method to increase the number of traces without challenging the fabrication process is to increase the number of active copper layers in the flexible cable structure with provisions to properly shield/ground these copper layers from one another to reduce cross-talk and/or other undesired electrical interference.

Aspects of the present disclosure are directed toward increasing the number of active traces in a flexible cable structure by adding additional copper layers in the main structure. For example, multiple copper clads can be bonded together, where each copper clad can be made of one polymeric (e.g., polyimide) layer sandwiched between two outer copper layers. Aspects of the present disclosure can then add multiple copper clads to a structure with each pair of copper clads separated by a thermally bondable adhesive layer. The number of copper clads that can be added is only limited by the desired flexibility expected for the flexible cable. For example, too many copper clads can cause the cable to become overly rigid. In applications that demand flexible cabling to accommodate small, crowded spaces, four copper layers can be appropriate.

Aspects of the present disclosure can bond at least two copper clads together, thereby obtaining four copper layers that can then be etched to carry the electrical traces that carry electrical signals for a desired electrical circuitry. Once the two copper clads are bonded, then one polymeric (e.g., polyimide) layer can be bonded to the top (e.g., top coverlay) and one polymeric layer can be bonded to the bottom (e.g., bottom coverlay).

Aspects of the present disclosure are applicable to any number of applications. For example, aspects of the present disclosure can be used to connect tape heads (e.g., a read tape head) to a main logic card in a tape storage system. Doing so can enable a tape head to reliably utilize 64 active channels (as compared to 32 active channels in traditional tape heads), for example. A tape head utilizing 64 active channels can read/write data in a range of 800 megabytes per second (MB/s) to 1,000 MB/s (compared to 400-500 MB/s in a traditional, 32-active channel tape head). Although a storage system application is discussed above, the electrical cabling discussed in the present disclosure can be used in any application benefiting from a wired communication channel having high bandwidth, high signal integrity, and mechanical flexibility.

Referring now to the figures, FIG. 1 illustrates a block diagram of a cross-section of a first example electrical cable 100, in accordance with some embodiments of the present disclosure. Electrical cable 100 includes, from upper to lower layers, a top polymeric cover layer 102, a top polymeric cover layer adhesive 104, a first copper layer 106, a first polymeric base layer 108, a first thermally bondable adhesive 110, a second copper layer 106, a second polymeric base layer 108, a third copper layer 106, a second thermally bondable adhesive 110, a third polymeric base layer 108, a fourth copper layer 106, a bottom polymeric cover layer adhesive 104, and a bottom polymeric cover layer 102.

Polymeric components (e.g., polymeric cover layers 102 and polymeric base layers 108) can be fabricated from any polymer material, now known or later developed. In some embodiments, the polymeric components can exhibit properties such as heat resistance (e.g., a relatively high glass transition temperature $T_g$, a relatively high crystalline melting point $T_m$, etc.), chemical resistance, durability, low density (e.g., lightweight), and flexibility. Polymeric components can include thermoset polymers, thermoplastic polymers, thermoplastic elastomers, elastomers, and/or other polymers. In some embodiments, polymeric components can be polyimides (PI) such as Kapton®. However, alternatives such as bismaleimides, epoxies (e.g., epoxy novolac), cyanate esters, phenolics, thiolytes, diallyl-phthalate (DAP), phenol-formaldehyde resins, polyetherketones (PEK), polyamide-imides (PAI), polyetheretherketones (PEEK), polyphenylsulfones (PPSU), polyphenylene sulfides (PPS), polyarylsulfones (PSU), polyethersulfones (PES), polyamide 11, polyamide 12, others, or a combination of the aforementioned.

Adhesive components (e.g., polymeric cover layer adhesives 104 and thermally bondable adhesive 110) can be any adhesive now known or later developed. In some embodiments, the polymeric cover layer adhesive 104 and/or the thermally bondable adhesive 110 can be a B-staged (e.g., partially cured) acrylic adhesive. In other embodiments, other adhesives can be used such as, but not limited to, drying adhesives (e.g., solvent based adhesives or emulsion adhesives), pressure sensitive adhesives (e.g., acrylate polymers having controlled molecular weights), contact adhesives (e.g., polymeric or elastomeric compounds undergoing pressure-induced strain crystallization such as polychloroprene), multi-part adhesives (e.g., reactive combinations of polyesters, polyurethanes, polyols, acrylics, epoxies, and/or other resins), one part adhesives (e.g., compounds or combinations thereof which react in the presence of ultraviolet (UV) radiation, heat, moisture, or other environmental factors), and/or other adhesives.

Copper layers 106 can be configured to carry electrical signals along a length of the first example electrical cable 100. Copper layers 106 can include ground layers and active layers. In some embodiments, the innermost two copper layers 106 can be ground copper layers 106 (e.g., second and third copper layers 106) and the outermost two copper layers 106 (e.g., first and fourth copper layers 106) can be active copper layers 106, where having the innermost copper layers 106 be ground copper layers 106 can reduce cross-talk and improve signal fidelity. Copper layers 106 can have various cross-sectional geometries such as spherical, oval, rectangular, and/or square in various embodiments. Although copper layers 106 are discussed herein, in other embodiments, any conductive layer capable of transmitting electrical, optical, and/or other data processing signals can be used.

In some embodiments, some adjacent components of the first example electrical cable 100 can be fabricated prior to manufacturing the entirety of the first example electrical cable 100. For example, the polymeric cover layer 102 and polymeric cover layer adhesive 104 can be separately manufactured as shown in group 112-1 and 112-2. The first copper layer 106 and the first polymeric base layer 108 (and likewise the third polymeric base layer 108 and the fourth copper layer 106) can likewise be separately manufactured as shown in group 114-1 and 114-2. Finally, the second copper layer 106, second polymeric base layer 108, and third copper layer 106 can be separately manufactured as shown in group 116. Groups 114-1, 114-2, and 116 can be referred to as cores. Groups 112-1 and 112-2 can be referred to as tapes, films, sheaths, or coverlays. Group 114-1 and 114-2 can be bonded to group 116 via the thermally bondable adhesive 110. Likewise, groups 112-1 and 112-2 can be adhered to an outermost surface of groups 114-1 and 114-2, respectively.

In some embodiments, the polymeric cover layers 102 can be approximately 12.5 micrometers (μm) thick, the polymeric cover layer adhesives 104 can be approximately 12.5 μm thick, the copper layers 106 can be approximate 9 μm thick, the outer polymeric base layers 108 (e.g., first and third polymeric base layers 108) can be approximately 12.5 μm thick, the middle polymeric base layer 108 can be approximately 25 μm thick, and the thermally bondable adhesive 110 can be approximately 25 μm thick. In these embodiments, the total thickness of the first example electrical cable 100 is approximately 186 μm thick.

In other embodiments, the thickness of the thermally bondable adhesives 110 can be reduced to 13 μm thick and the thickness of the middle polymeric base layer 108 can be reduced to approximately 12.5 μm thick. In embodiments with these layers having selectively reduced thickness, the overall thickness of the first example electrical cable 100 can be approximately 149.5 μm thick. These reductions in thickness can increase the flexibility of the first example electrical cable 100 while maintaining acceptable structural integrity and signal fidelity of the first example electrical cable 100.

Figure 2:
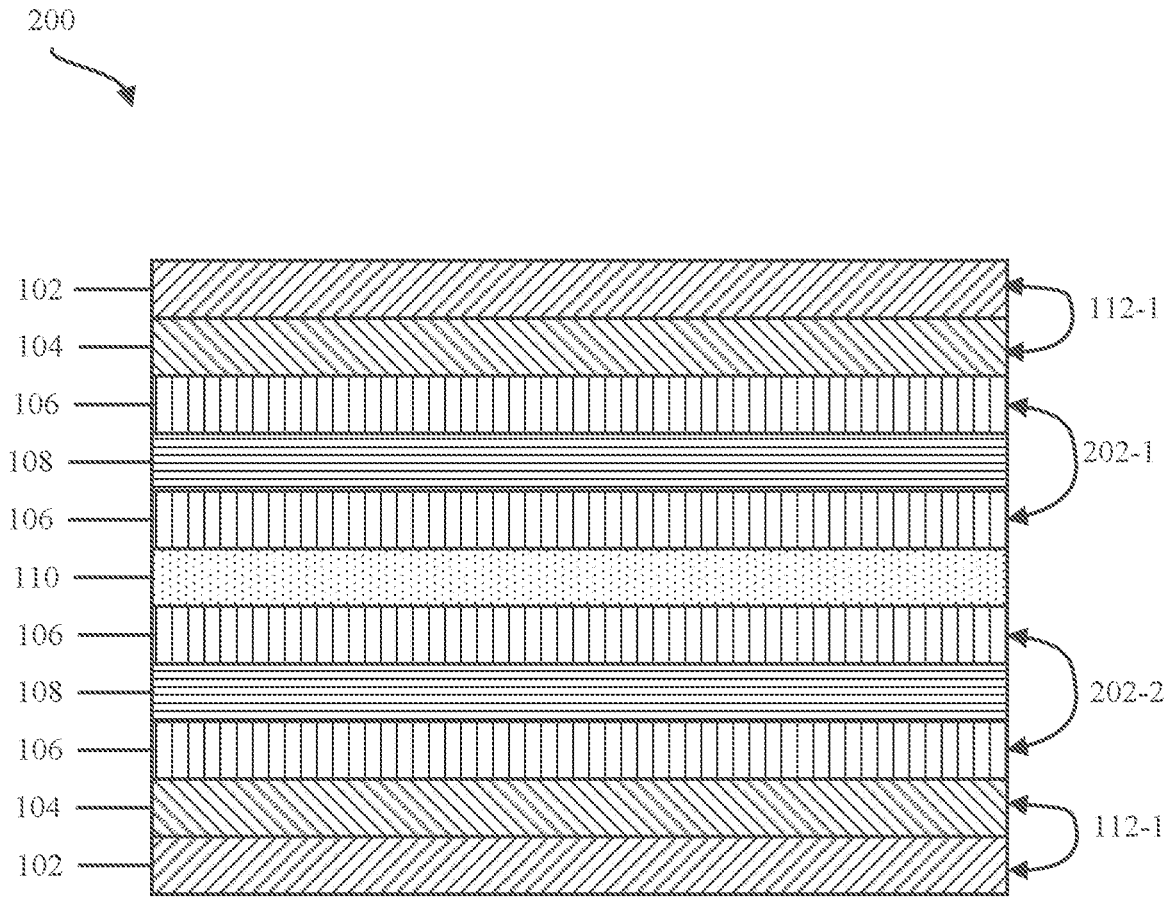
FIG. 2 illustrates a block diagram of a cross-section of a second example electrical cable, in accordance with some embodiments of the present disclosure.

FIG. 2 illustrates a block diagram of a cross-section of a second example electrical cable 200, in accordance with some embodiments of the present disclosure. Whereas the first example electrical cable 100 of FIG. 1 reduced overall thickness by reducing thicknesses of individual layers, FIG. 2 illustrates a mechanism for realizing the second example electrical cable 200 with reduced overall thickness by modifying the sequence of layers in the second example electrical cable 200.

The second example electrical cable 200 includes, from top to bottom, a top polymeric cover layer 102, top polymeric cover layer adhesive 104, first copper layer 106, first polymeric base layer 108, second copper layer 106, a thermally bondable adhesive 110, third copper layer 106, second polymeric base layer 108, fourth copper layer 106, bottom polymeric cover layer adhesive 104, and bottom polymeric cover layer 102. As discussed with respect to FIG. 1, the innermost two copper layers 106 of the second example electrical cable 200 can be ground copper layers 106, where having the innermost two copper layers 106 be ground copper layers 106 can result in improved signal fidelity and/or reduced cross-talk between the copper layers 106.

As shown in FIG. 2, the second example electrical cable 200 includes fewer layers relative to the first example electrical cable 100 of FIG. 1. For example, the second example electrical cable 200 includes one thermally bondable adhesive 110 layer (compared to two such layers in FIG. 1) and two polymeric base layers 108 (compared to three such layers in FIG. 1). By reducing the number of layers, the aspects of the present disclosure illustrated in FIG. 2 can realize improved flexibility (via reduced thickness) while maintaining the performance advantages of having four copper layers 106 in the second example electrical cable 200.

In some embodiments, some adjacent components of the second example electrical cable 200 are separately manufactured prior to fabrication of the second example electrical cable 200. For example, the top polymeric cover layer 102 and top polymeric cover layer adhesive 104 (and likewise the bottom polymeric cover layer 102 and bottom polymeric cover layer adhesive 104) can be separately manufactured as shown in group 112-1 and 112-2. As another example, a polymeric base layer 108 sandwiched between two copper layers 106 (also referred to as cores 202) can also be separately manufactured (such as top core 202-1 and bottom core 202-2). Such cores 202 can be subsequently bonded to one another by thermally bondable adhesive 110 and finished by applying polymeric cover layer 102 and polymeric cover layer adhesive 104.

In some embodiments, the polymeric cover layers 102 can be approximately 12.5 μm thick, the polymeric cover layer adhesives 104 can be approximately 12.5 μm thick, the copper layers 106 can be approximate 9 μm thick, the polymeric base layers 108 can be approximately 12.5 μm thick, and the thermally bondable adhesive 110 can be approximately 13 μm thick. In these embodiments, the total thickness of the second example electrical cable 200 can be approximately 124 μm thick. As previously discussed, decreasing thickness of the second example electrical cable 200 can increase the flexibility of the second example electrical cable 200 (while maintaining adequate signal fidelity), thereby enabling the second example electrical cable 200 to flexibly couple multiple electronic components in various configurations.

Collectively, the first example electrical cable 100 and the second example electrical cable 200 can realize numerous advantages. As an example electronic advantage, the first example electrical cable 100 and the second example electrical cable 200 can realize increased communication bandwidth by virtue of having four copper layers 106 (rather than two copper layers as is traditionally done). Furthermore, the first example electrical cable 100 and the second example electrical cable 200 can realize adequate signal fidelity (e.g., reduced cross-talk) between the four copper layers 106 by virtue of insulating copper layers 106 from each other by at least one of a polymeric base layer 108 and/or a thermally bondable adhesive 110. The polymeric base layer 108 and the thermally bondable adhesive 110 each exhibit inherent electrically insulative properties. These insulative properties, together with the appropriate thickness of the polymeric base layer 108 and/or the thermally bondable adhesive 110, enable adequate signal fidelity by the copper layers 106. As an example mechanical advantage, the first example electrical cable 100 and the second example electrical cable 200 can realize sufficient flexibility to improve connectability between electronic components. Sufficient flexibility can be achieved by selectively reducing layer thicknesses and/or altering stack configurations in the first example electrical cable 100 and the second example electrical cable 200. Flexibility in the first example electrical cable 100 and the second example electrical cable 200 can enable the first example electrical cable 100 and the second example electrical cable 200 to be designed into, or retrofitted onto, electronic systems having restricted space limitations and/or crowded cabling configurations.

Figure 3A:
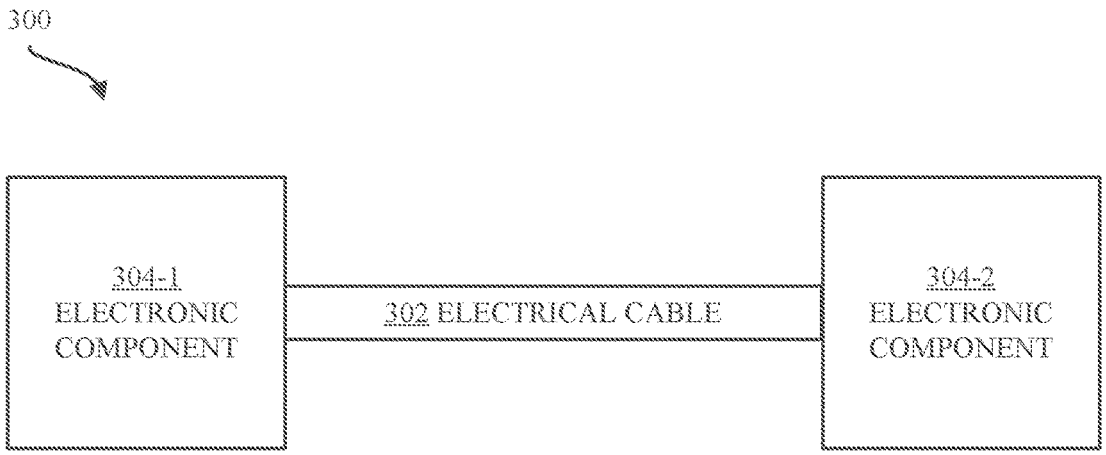
FIG. 3A illustrates a block diagram of an electrical cable coupling electronic components, in accordance with some embodiments of the present disclosure.

FIG. 3A illustrates a block diagram of a system 300 including an electrical cable 302 coupling electronic components 304, in accordance with some embodiments of the present disclosure. Electrical cable 302 can be, for example, the first example electrical cable 100 of FIG. 1 or the second example electrical cable 200 of FIG. 2. Electronic components 304 (e.g., a first electronic component 304-1 and a second electronic component 304-2) can be any electronic component that generates, transmits, receives, and/or implements data processing signals. As one example, the first electronic component 304-1 can be a component of a tape storage system such as a main logic board, and the second electronic component 304-2 can be a tape head (e.g., read head) of the tape storage system. In this example, the electrical cable 302 is advantageously able to transmit large amounts of electrical signal information between the main logic board and the tape head (due to the four copper layers 106), with high fidelity (e.g., due the limited cross-talk realized by the arrangement of the four copper layers 106 within the electrical cable 302), and with adequate flexibility (as realized by the reduced overall thickness of the electrical cable 302).

Figure 3B:
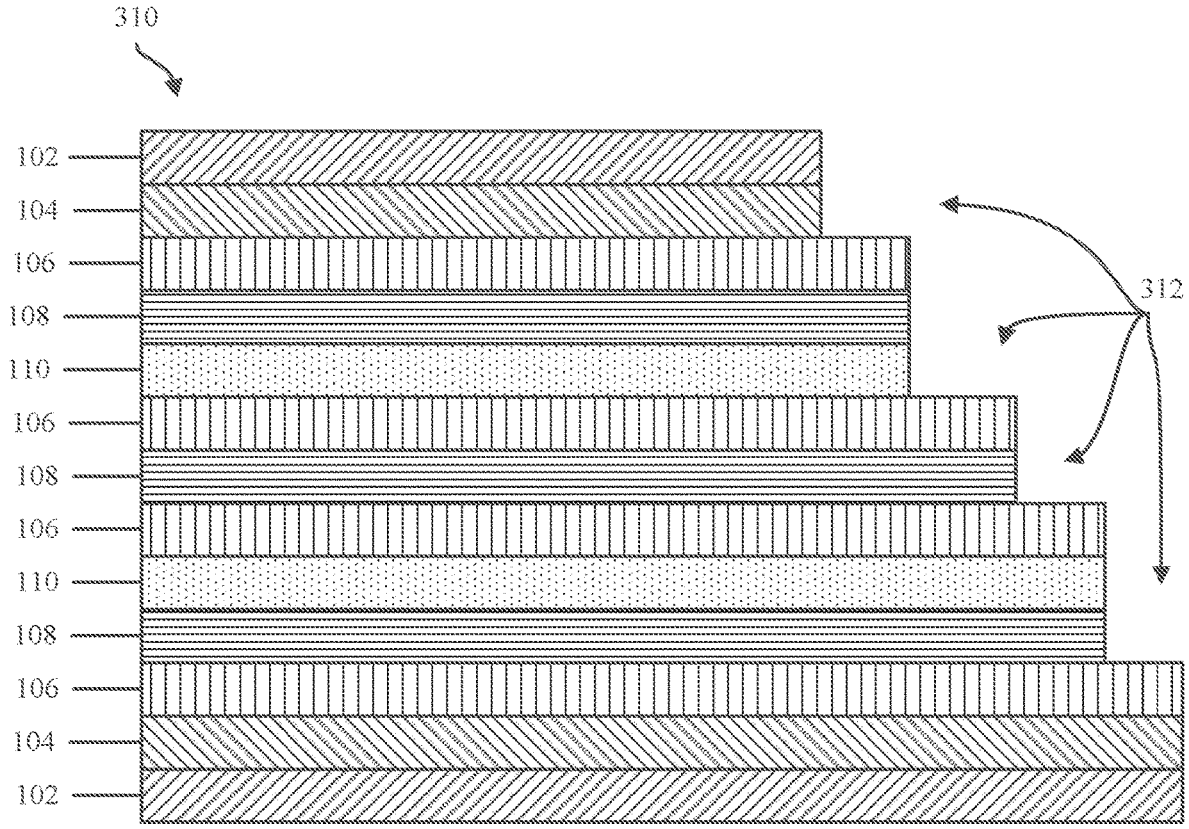
FIG. 3B illustrates a block diagram of a cross-section of an end connection of an electrical cable, in accordance with some embodiments of the present disclosure.

FIG. 3B illustrates a block diagram of a cross-section of an end connection 310 of an electrical cable 302, in accordance with some embodiments of the present disclosure. The end connection can include a plurality of steps 312, where each step 312 exposes a copper layer 106 and corresponding signal trace elements. In some embodiments, the steps 312 are created by removing a base layer (e.g., polymeric base layer 108 and/or thermally bondable adhesive 110). In some embodiments, the steps 312 are created by laser ablation. In some embodiments, copper layers 106 and/or cover layers (e.g., polymeric cover layer 102 and polymeric cover layer adhesive 104) can be cute to size and do not need to have any material removed by laser ablation or otherwise.

Figure 4:
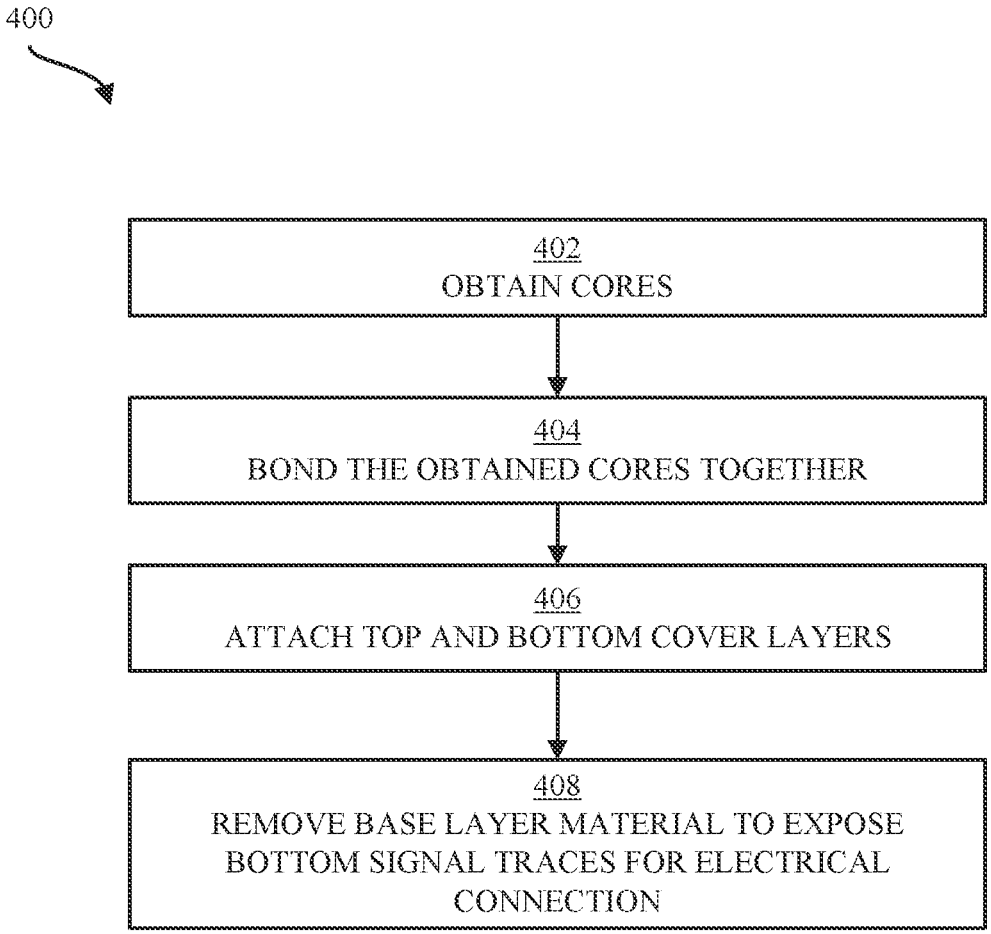
FIG. 4 illustrates a flowchart of an example method for fabricating an electrical cable, in accordance with some embodiments of the present disclosure.

FIG. 4 illustrates a flowchart of an example method 400 for fabricating an electrical cable 200, in accordance with some embodiments of the present disclosure. In operation 402, two cores 202 are obtained. The two cores 202 can be obtained from a supplier or manufactured in-house. When manufactured in-house, two copper layers 106 can sandwich a polymeric base layer 108, and the core 202 can be cured to bond the copper layers 106 to the polymeric base layer 108. When manufactured in-house, operation 402 can involve a cure schedule of controlled pressure, heat, humidity, and/or other factors to appropriately cure the polymeric base layer 108, and in doing so, bond it to the adjacent copper layers 106. In some embodiments, operation 402 utilizes a heated press, an autoclave, a vacuum in combination with an oven, and/or other configurations of manufacturing devices to the copper layers 106 to the polymeric base layer 108 to create the cores 202.

In operation 404, the two cores 202 are bonded together using a thermally bondable adhesive 110. Operation 404 can involve a cure schedule of controlled pressure, heat, humidity, and/or other factors to appropriately activate the thermally bondable adhesive 110. In some embodiments, operation 404 utilizes a heated press, an autoclave, a vacuum in combination with an oven, and/or other configurations of manufacturing devices to bond the two cores 202 together using the thermally bondable adhesive 110. In embodiments where adhesives other than a thermally activated adhesive are used, operation 404 can involve activating a catalyst to bond the two cores 202 together, whether that catalyst be a chemical reactant or an environmental catalyst such as UV light, pressure, and/or time.

In operation 406, a top polymeric cover layer 102 and a bottom polymeric cover layer 102 are adhered to the electrical cable 200 using a top polymeric cover layer adhesive 104 and a bottom polymeric cover layer adhesive 104, respectively. Operation 406 can utilize any combination of temperature, pressure, time, humidity, chemical reactants, UV light, and/or other catalysts to adhere the top polymeric cover layer 102 and the bottom polymeric cover layer 102 to the second example electrical cable 200 using the top polymeric cover layer adhesive 104 and the bottom polymeric cover layer adhesive 104, respectively.

In operation 408, base layer material (e.g., from polymeric base layer 108 and/or thermally bondable adhesive 110) can be removed on an end of the electrical cable 200 (e.g., end connection 310) in order to expose bottom signal traces for an electrical connection. In some embodiments, operation 408 utilizes laser ablation to remove the base layer material. In some embodiments, operation 408 results in a stepped cross-section of the electrical cable 200 at the electrical connection (e.g., at an end of the electrical cable 200 where the electrical cable connects to an electronic component 304. In some embodiments, the cover layers (e.g., polymeric cover layers 102 and polymeric cover layer adhesives 104) can be die cut prior to lamination to expose the upper trace layers. Furthermore, in some embodiments, the copper layers 106 positioned above other copper layers 106 can be etched such that upper copper layers 106 end before lower copper layers 106 so that the lower copper layers 106 can be exposed.

As will be appreciated by one skilled in the art, the dimensions shown in the drawings, whether absolute or relative, are not necessarily to scale. Furthermore, the configurations shown in the drawings and described in the specification are intended to be representative of some embodiments and are simplified for ease of discussion. While some dimensions are provided in the specification, such dimensions should be understood to be examples, with other dimensions (larger or smaller) possible in other embodiments. Furthermore, such dimensions can be approximate, where the term approximate can represent a reasonable variation in dimension as a result of design factors, manufacturing capabilities, material properties, and/or other considerations. As another example, a dimension referred to as approximate can be represented by an associated tolerance with the given dimension, such as ±10%, or another example tolerance.

The terminology used herein is for the purpose of describing particular embodiments only and is not intended to be limiting of the various embodiments. As used herein, the singular forms "a," "an," and "the" are intended to include the plural forms as well, unless the context clearly indicates otherwise. It will be further understood that the terms "includes" and/or "including," when used in this specification, specify the presence of the stated features, integers, steps, operations, elements, and/or components, but do not preclude the presence or addition of one or more other features, integers, steps, operations, elements, components, and/or groups thereof. In the previous detailed description of example embodiments of the various embodiments, reference was made to the accompanying drawings (where like numbers represent like elements), which form a part hereof, and in which is shown by way of illustration specific example embodiments in which the various embodiments can be practiced. These embodiments were described in sufficient detail to enable those skilled in the art to practice the embodiments, but other embodiments can be used and logical, mechanical, electrical, and other changes can be made without departing from the scope of the various embodiments. In the previous description, numerous specific details were set forth to provide a thorough understanding the various embodiments. But the various embodiments can be practiced without these specific details. In other instances, well-known circuits, structures, and techniques have not been shown in detail in order not to obscure embodiments.

Different instances of the word "embodiment" as used within this specification do not necessarily refer to the same embodiment, but they can. Any data and data structures illustrated or described herein are examples only, and in other embodiments, different amounts of data, types of data, fields, numbers and types of fields, field names, numbers and types of rows, records, entries, or organizations of data can be used. In addition, any data can be combined with logic, so that a separate data structure may not be necessary. The previous detailed description is, therefore, not to be taken in a limiting sense.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although the present disclosure has been described in terms of specific embodiments, it is anticipated that alterations and modification thereof will become apparent to the skilled in the art. Therefore, it is intended that the following claims be interpreted as covering all such alterations and modifications as fall within the true spirit and scope of the disclosure.

Any advantages discussed in the present disclosure are example advantages, and embodiments of the present disclosure can exist that realize all, some, or none of any of the discussed advantages while remaining within the spirit and scope of the present disclosure.

The following is a non-limiting list of examples of aspects of the present disclosure. Example 1 is an electrical cable comprising: first and second cores, each core including a polymeric base layer sandwiched by top and bottom copper layers; an adhesive layer between the first and second cores and bonding the first and second cores together; and a first polymeric cover layer bonded to an outer surface of the first core, and a second polymeric cover layer bonded to an outer surface of the second core.

Example 2 includes example 1, including or excluding optional features. In this example, the polymeric base layer comprises a polyimide.

Example 3 includes any one of examples 1 to 2, including or excluding optional features. In this example, the first polymeric cover layer and the second polymeric cover layer each comprise a polyimide.

Example 4 includes any one of examples 1 to 3, including or excluding optional features. In this example, the adhesive layer is a thermally bondable adhesive.

Example 5 includes any one of examples 1 to 4, including or excluding optional features. In this example, the electrical cable is coupled to a tape head.

Example 6 includes any one of examples 1 to 5, including or excluding optional features. In this example, a thickness of the electrical cable is less than 125 micrometers (μm).

Example 7 is an electrical cable comprising: a top polymeric cover layer adhered to a first core, the first core comprising a first copper layer and a first polymeric base layer; a second core bonded to the first core, wherein the second core comprises a second polymeric base layer sandwiched between a second copper layer and a third copper layer; a third core bonded to the second core, the third core comprising a fourth copper layer and a third polymeric base layer; and a bottom polymeric cover layer adhered to the third core.

Example 8 includes example 7, including or excluding optional features. In this example, the first polymeric base layer, the second polymeric base layer, and the third polymeric base layer each comprise a polyimide.

Example 9 includes any one of Examples 7 to 8, including or excluding optional features. In this example, the top polymeric cover layer and the bottom polymeric cover layer each comprise a polyimide.

Example 10 includes any one of Examples 7 to 9, including or excluding optional features. In this example, the first core is bonded to the second core and the second core is bonded to the third core by a thermally bondable adhesive.

Example 11 includes any one of Examples 7 to 10, including or excluding optional features. In this example, the electrical cable is coupled to a tape head.

Example 12 includes any one of Examples 7 to 11, including or excluding optional features. In this example, a thickness of the electrical cable is less than 190 micrometers (μm).

Example 13 includes any one of Examples 7 to 11, including or excluding optional features. In this example, a thickness of the electrical cable is less than 150 micrometers (μm).

Example 14 is an electrical cable comprising: four copper layers, wherein at least two of the four copper layers are separated by a polymeric base layer, and wherein at least two of the four copper layers are separated by an adhesive; and a polymeric cover layer adhered to an outermost copper layer.

Example 15 includes Example 14, including or excluding optional features. In this example, the polymeric base layer comprises a polyimide.

Example 16 includes any one of Examples 14 to 15, including or excluding optional features. In this example, bottom signal traces are exposed in a stepped cross-section at an end of the electrical cable, wherein the bottom signal traces are exposed using laser ablation.

Example 17 includes any one of Examples 14 to 16, including or excluding optional features. In this example, the adhesive comprises a thermally bondable adhesive.

Example 18 includes any one of Examples 14 to 17, including or excluding optional features. In this example, the electrical cable is coupled to a tape head.

Example 19 includes any one of Examples 14 to 18, including or excluding optional features. In this example, a thickness of the electrical cable is less than 125 micrometers (μm).

Example 20 includes any one of Examples 14 to 19, including or excluding optional features. In this example, two innermost copper layers of the at least four copper layers are ground copper layers.

What is claimed is:

1. An electrical cable comprising:

first and second cores, each core including a polymeric base layer sandwiched by top and bottom copper layers;

an adhesive layer between the first and second cores and bonding the first and second cores together;

a first polymeric cover layer bonded to an outer surface of the first core, and a second polymeric cover layer bonded to an outer surface of the second core; and wherein two innermost copper layers of the electrical cable are ground copper layers, and wherein two outermost copper layers of the electrical cable are active copper layers.

2. The electrical cable of claim 1, wherein the polymeric base layer comprises a polyimide.

3. The electrical cable of claim 1, wherein the first polymeric cover layer and the second polymeric cover layer each comprise a polyimide.

4. The electrical cable of claim 1, wherein the adhesive layer is a thermally bondable adhesive.

5. The electrical cable of claim 1, wherein the electrical cable is coupled to a tape head.

6. The electrical cable of claim 1, wherein a thickness of the electrical cable is less than 125 micrometers (μm).

7. An electrical cable comprising:

a top polymeric cover layer adhered to a first core, the first core comprising a first copper layer and a first polymeric base layer;

a second core bonded to the first core, wherein the second core comprises a second polymeric base layer sandwiched between a second copper layer and a third copper layer;

a third core bonded to the second core, the third core comprising a fourth copper layer and a third polymeric base layer;

a bottom polymeric cover layer adhered to the third core; and wherein the second copper layer and the third copper layer are two innermost copper layers and are ground copper layers, and wherein the first copper layer and the fourth copper layer are two outermost copper layers and are active copper layers.

8. The electrical cable of claim 7, wherein the first polymeric base layer, the second polymeric base layer, and the third polymeric base layer each comprise a polyimide.

9. The electrical cable of claim 7, wherein the top polymeric cover layer and the bottom polymeric cover layer each comprise a polyimide.

10. The electrical cable of claim 7, wherein the first core is bonded to the second core and the second core is bonded to the third core by a thermally bondable adhesive.

11. The electrical cable of claim 7, wherein the electrical cable is coupled to a tape head.

12. The electrical cable of claim 7, wherein a thickness of the electrical cable is less than 190 micrometers (μm).

13. The electrical cable of claim 7, wherein a thickness of the electrical cable is less than 150 micrometers (μm).

14. An electrical cable comprising:

four copper layers, wherein at least two of the four copper layers are separated by a polymeric base layer, wherein at least two of the four copper layers are separated by an adhesive, wherein two innermost copper layers of the four copper layers are ground copper layers, and wherein two outermost copper layers of the four copper layers are active copper layers; and a polymeric cover layer adhered to an outermost copper layer.

15. The electrical cable of claim 14, wherein the polymeric base layer comprises a polyimide.

16. The electrical cable of claim 14, wherein bottom signal traces are exposed in a stepped cross-section at an end of the electrical cable, wherein the bottom signal traces are exposed using laser ablation.

17. The electrical cable of claim 14, wherein the adhesive comprises a thermally bondable adhesive.

18. The electrical cable of claim 14, wherein the electrical cable is coupled to a tape head.

19. The electrical cable of claim 14, wherein a thickness of the electrical cable is less than 125 micrometers (μm).

* * * * *